US006192552B1

(12) United States Patent
Murphy

(10) Patent No.: US 6,192,552 B1
(45) Date of Patent: Feb. 27, 2001

(54) APPARATUS AND METHOD FOR SECURING A DOOR IN ITS OPEN POSITION

(76) Inventor: Hugh M. Murphy, 151 Locust Ct., Arden, NC (US) 28704

( * ) Notice: Subject to any disclaimer, the term of this patent is extended or adjusted under 35 U.S.C. 154(b) by 0 days.

(21) Appl. No.: 09/322,432

(22) Filed: May 28, 1999

(51) Int. Cl.[7] ..... E05F 5/06
(52) U.S. Cl. ..... 16/85; 16/82
(58) Field of Search ..... 16/85, 82, 86 R, 16/86 A; 292/DIG. 15, DIG. 19

(56) References Cited

U.S. PATENT DOCUMENTS

| | | | | |
|---|---|---|---|---|
| 2,496,691 | * | 2/1950 | Berry | 16/82 |
| 3,100,664 | * | 8/1963 | Duval | 16/82 |
| 3,758,141 | * | 9/1973 | Weinberger | 16/82 |
| 4,084,290 | * | 4/1978 | Lymar et al. | 16/87 R |
| 4,218,807 | * | 8/1980 | Snow | 16/86 A |
| 4,995,655 | * | 2/1991 | Freeman | 292/DIG. 19 |
| 5,575,514 | * | 11/1996 | Troy | 292/DIG. 19 |
| 5,887,917 | | 3/1999 | Luciana . | |

* cited by examiner

*Primary Examiner*—Chuck Y. Mah
(74) *Attorney, Agent, or Firm*—Carter & Schnedler, P.A.

(57) ABSTRACT

There is provided a method and apparatus for securing a door in its open position. A cylinder is provided having a first hook and loop type fastener attached to one end. The cylinder is attached to a wall mountable door stop. A second hook and loop type fastener is attached to the door. The second hook and loop type fastener aligns with and is adapted to make contact with the first hook and loop type fastener when the door is fully open, thereby securing the door in its open position. The second hook and loop type fastener includes an adhesive backing. The second hook and loop type fastener becomes attached to the door by first attaching the first hook and loop fastener to the second hook and loop fastener, and then opening the door so that the door makes contact with the adhesive backing of the second hook and loop type fastener. The door is then at least partially closed and the second hook and loop type fastener becomes detached from the first hook and loop type fastener and attached to the door.

5 Claims, 3 Drawing Sheets

APPARATUS AND METHOD FOR SECURING A DOOR IN ITS OPEN POSITION

BACKGROUND OF THE INVENTION

This invention relates to a method and apparatus for securing a door in an open position. More particularly it relates to a method and apparatus for retrofitting an existing door stop to enable a door to be secured in its open position.

When a properly hung door is opened, normally it will stay in its open position. However, if the door was not properly hung, or if a properly hung door becomes out of balance because of shifting of the door frame, movement of the hinges, or an overall shifting in the building, it may undesirably become closed. The closing of the door which the occupant prefers to be open can be frustrating.

There have been various attempts to over come this problem, such as, for example, attaching a latching mechanism to one side of the door and the adjacent wall, and using magnets which are attached to the wall and to the door, such as taught in U.S. Pat. No. 5,887,917. Both of these techniques require substantial modifications to the door and to the wall.

It is, therefore, desirable to secure a door in its open position without the need to substantially modify the door or wall.

OBJECTS OF THE INVENTION

It is therefore one object of the invention to provide an improved method and apparatus to secure a door in its open position.

It is another object of the invention to provide a method and apparatus to secure a door in its open position which involves a simple retrofit of an existing door stop.

It is still another object of the invention to provide an apparatus to secure a door in its open position which is inexpensive and easy to use.

SUMMARY OF THE INVENTION

In accordance with one form of the invention, there is provided an apparatus for securing a door in its open position. A substrate is provided, which is preferably in the form of a cylinder. A first hook and loop type fastener piece is attached to the substrate. A second hook and loop type fastener piece is provided. The second hook and loop type fastener piece includes a front side having the fastener surface, and a back side having an adhesive received thereon. The substrate is adapted to be attached to a door stop, which is preferably wall mountable. The back side of the second hook and loop type fastener piece is adapted to be attached to a surface, which is preferably the door. The front side of the second hook and loop type fastener piece is removably attached to the first hook and loop type fastener piece. Preferably, the adhesive portion of the second hook and loop type fastener piece has a removable release cover attached thereto.

In accordance with another form of this invention, there is provided a method for securing a door in its open position, including the steps of: attaching a substrate having a first hook and loop type fastener piece to a door stop; attaching a second hook and loop type fastener piece to the first hook and loop type fastener piece; the second hook and loop type fastener piece having a front fastener side and a back adhesive side with a release cover attached to the adhesive; removing the release cover from the back side of the second hook and loop type fastener piece; opening the door to its full open position so that the door strikes the door stop and the adhesive, thereby adhering the second hook and loop type fastener piece to the door; closing the door at least partially so that the second hook and loop type fastener piece becomes detached from the first hook and loop type fastener piece and attached to the door; opening the door to the full open position so that the second hook and loop type fastener piece on the door contacts the first hook and loop type fastener piece on the door stop, whereby the door is secured in the open position.

BRIEF DESCRIPTION OF THE DRAWINGS

The subject matter which is regarded as the invention is set forth in the appended claims. The invention itself, however, together with further objects and advantages thereof may be better understood in reference to the accompanying drawings in which:

DESCRIPTION OF THE PREFERRED EMBODIMENTS

Figure 1:
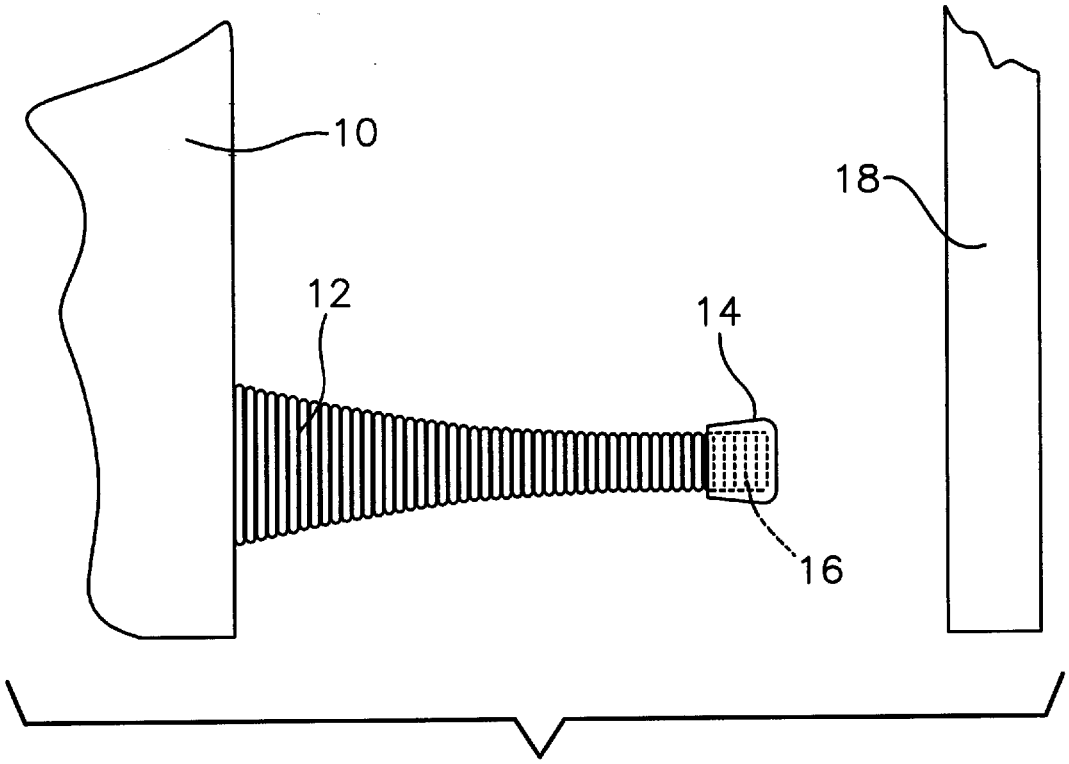
Fig. 1 Prior Art
FIG. 1 is a side elevational view showing a prior art wall mounted door stop and a door.

FIG. 1 shows wall 10 having a standard door stop 12 mounted thereto near the bottom of the wall. Door stop 12 includes a rubber cushion 14 attached to free end 16 of door stop 12. Door 18 swings open and close. In its full open position, door 18 will strike rubber cushion 14.

Figure 2:
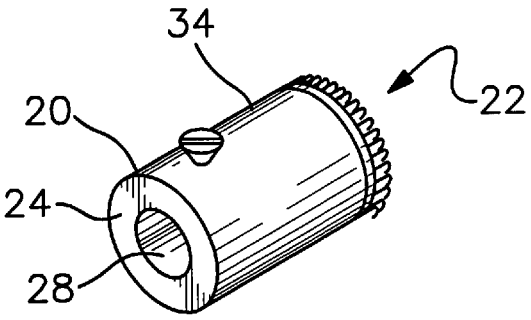
FIG. 2 is a perspective view of a device incorporating features of the present invention showing one end thereof.
Figure 3:
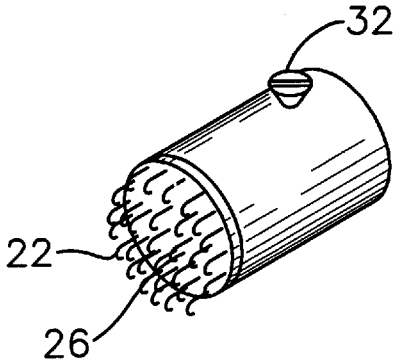
FIG. 3 is a perspective view of the device of FIG. 2 showing the other end thereof.
Figure 4:
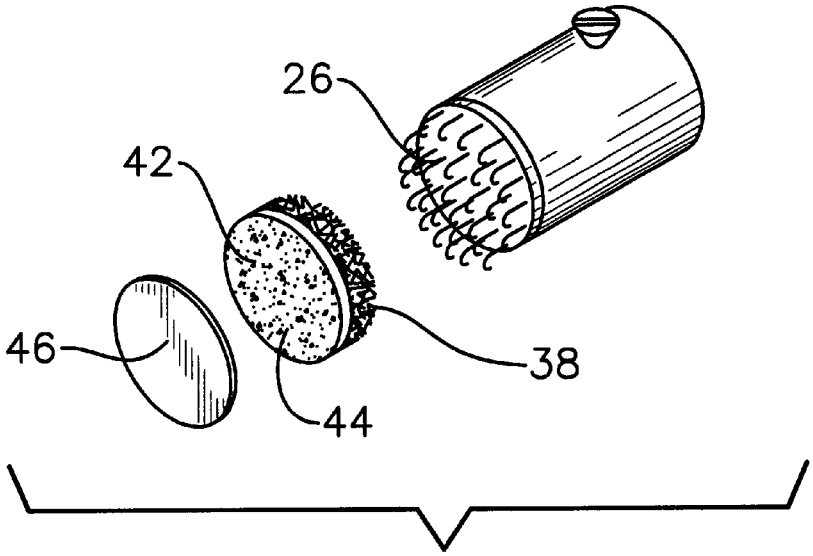
FIG. 4 is an exploded view of a device incorporating features of the present invention.
Figure 5:
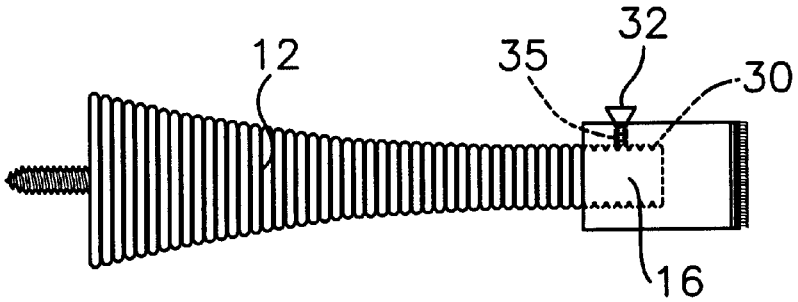
FIG. 5 is a side elevational view of the device of FIG. 2 having been attached to a door stop.

Referring now to FIGS. 2–4, there is provided substrate 20, preferably in the form of a cylinder, which may be made of various materials, such as plastic or wood. Cylinder 20 includes a front side 22 and a back side 24. The front side 22 of cylinder 20 has a first hook and loop type fastener piece 26 affixed thereto by adhesive. Back side 24 of cylinder 20 includes an opening 28 forming a cavity 30 inside cylinder 20, as illustrated in FIG. 5. After the rubber cushion 14 has been removed, the free end 16 of door stop 12 is placed in cavity 30 of cylinder 20 so that cylinder 20 becomes mounted on door stop 12. Set screw 32 is received in the curved side 34 of cylinder 20 through bore hole 35 to secure cylinder 20 onto door stop 12.

Figure 4A:
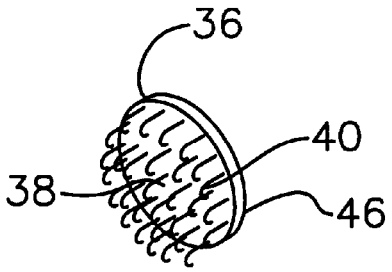
FIG. 4A is a pictorial view of a portion of the device of FIG. 4.

Referring now more particularly to FIG. 4A, a second hook and loop type fastener piece 36 is adapted to be removably attached to the first hook and loop type fastener piece 26. The second hook and loop type fastener piece includes a front side 38 having fastener 40 and a back side 42 which is coated with an adhesive 44. A release cover 46 is removably received over adhesive 44.

As used herein, the term hook and loop type fastener piece means a piece having either hooks or loops.

The preferred hook and loop type fastener is a Velcro fastener. The first fastener 26 may contain the hoods and the second fastener 36 may contain the loops, or the first fastener 26 may contain the loops and the second fastener 36 may contain the hooks.

Figure 6:
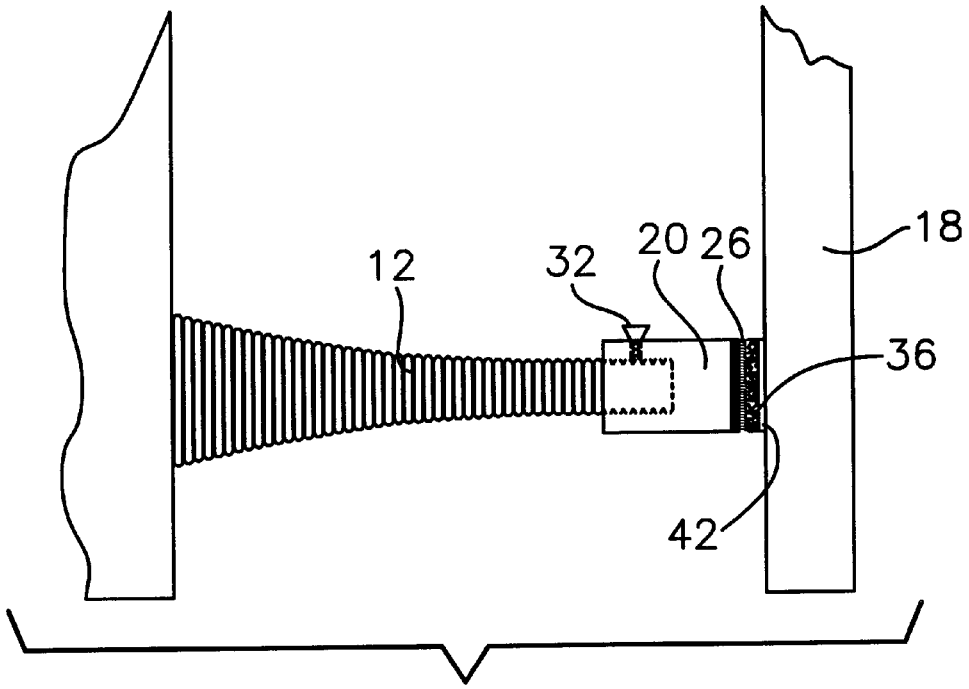
FIG. 6 is a side elevational view of the device of FIG. 4 having been attached to a door stop and to a door with the door being in the full open position.
Figure 7:
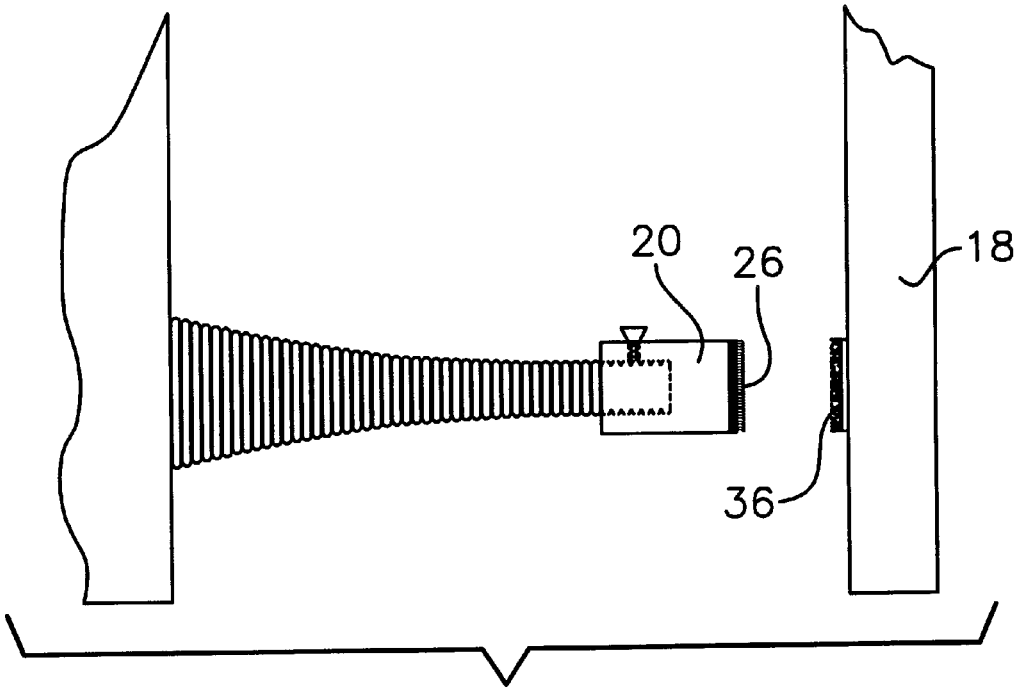
FIG. 7 is shows the apparatus of FIG. 6, however, with the door being slightly closed.

Referring now more particularly to FIGS. 6 and 7, the second hook and loop type fastener piece 36 is attached to the first hook and loop type fastener piece 26 by intermating their respective fastener surfaces. Cylinder 20 is attached to door stop 12 and is secured to door stop 12 by set screw 32. Release cover 46 is removed, thereby exposing adhesive surface 44.

Door 18 is moved to its full open position so that a lower portion of door 18 makes contact with adhesive surface 44 of second hook and loop type fastener 36, thereby adhering it to door 18.

Referring now to FIG. 7, door 18 is then moved towards its closed position so that second hook and loop type fastener piece 36 is detached from first hook and loop type fastener piece 26, and thus from cylinder 20, and becomes attached to door 18 because the bond of adhesive 44 is stronger than the bond created when the first hook and loop type fastener piece and the second hook and loop type fastener piece are intermated.

This procedure will automatically place the first hook and loop type fastener piece in register with the second hook and loop type fastener piece when the door is fully open. When it is desirable to secure the door 18 in its open position, one simply fully opens the door and the first hook and loop type fastener piece 26 will make contact with the second hook and loop type fastener piece 36. The door 18 will remain open until someone intentionally closes it by applying enough force to break the bond between fastener pieces 26 and 36.

Thus there is provided a simple and inexpensive method and apparatus for securing a door in its open position by making a simple retrofit to existing door stops by removing the rubber cushion from the door stop and replacing it with a cylinder having the hook and loop type fastener pieces attached thereto, as described above.

From the foregoing description of the preferred embodiment of the invention, it will be apparent that many modifications may be made therein. It should be understood, however, that this embodiment of the invention is an exemplification of the invention only and that the invention is not limited thereto. For example, the door stop could be placed on the door and the second hook and loop type fastener piece could be secured to the wall. In addition, the door stop could be floor mountable. It is to be understood, therefore, that it is intended in the appended claims to cover all modifications as fall within the true spirit and scope of the invention.

What is claimed is:

1. A method for securing a door in its open position, comprising the steps of:

attaching a substrate having a first hook and loop type fastener piece to a door stop;

attaching a second hook and loop type fastener piece to the first hook and loop type fastener piece; said second hook and loop type fastener piece having a front hook and loop type fastener side and a back adhesive side with a release cover attached to said adhesive side;

removing the release cover from the back adhesive side of the second hook and loop type fastener piece;

opening the door to its full open position so that the door strikes the door stop and the adhesive, thereby adhering the second hook and loop type fastener piece to the door;

closing the door, at least partially, so that the second hook and loop type fastener piece becomes detached from the first hook and loop type piece and attached to the door;

opening the door to the full open position so that the second hook and loop type fastener piece on the door contacts the first hook and loop type fastener piece on the door stop, whereby the door is secured in its open position.

2. A method as set forth in claim 1, wherein said substrate is in the form of a cylinder.

3. A method as set forth in claim 2, wherein said cylinder has first and second ends; said first end of said cylinder having an opening therein; said opening adapted to receive a portion of the door stop; said first hook and loop type fastener piece being attached to said second end of said cylinder.

4. A method as set forth in claim 3, further including a set screw attached to said cylinder for securing said cylinder to said door stop.

5. A method as set forth in claim 1, wherein the adhesive bond between the second hook and loop type fastener piece on the door being stronger than the bond between the first hook and loop type fastener piece and the second hook and loop type fastener piece.

* * * * *